US005617584A

United States Patent [19]

Brennan

[11] Patent Number: 5,617,584

[45] Date of Patent: Apr. 8, 1997

[54] FACE COVERING

[76] Inventor: Michael K. Brennan, 141-33 13th Ave., Whitestone, N.Y. 11357-2316

[21] Appl. No.: 419,198

[22] Filed: Apr. 10, 1995

[51] Int. Cl.[6] ..... A42B 3/18

[52] U.S. Cl. ..... 2/206; 2/9; 2/172; 2/207

[58] Field of Search ..... 2/172, 207, 9, 2/173, 174, 206, 423, 424; D2/884

[56] References Cited

U.S. PATENT DOCUMENTS

| | | | |
|---|---|---|---|
| D. 337,645 | 7/1993 | Guziejka | D2/884 |
| 891,122 | 6/1908 | Wilcox | 2/206 |
| 3,990,397 | 11/1976 | Lowe, Jr. . | |
| 4,271,544 | 6/1981 | Hammond . | |
| 5,042,430 | 8/1991 | Casmira . | |
| 5,161,260 | 11/1992 | Reynolds | 2/207 |
| 5,329,878 | 7/1994 | McCauley . | |

FOREIGN PATENT DOCUMENTS

| | | | |
|---|---|---|---|
| 330681 | 7/1958 | France | 2/206 |
| 229872 | 3/1925 | United Kingdom | 2/207 |

*Primary Examiner*—Diana Biefeld
*Attorney, Agent, or Firm*—Michael I. Kroll

[57] ABSTRACT

A multipurpose bandanna-type article comprising an elongated band, a flexible panel and a facility for fastening one edge of the flexible panel to the elongated band.

1 Claim, 3 Drawing Sheets

FACE COVERING

BACKGROUND OF THE INVENTION

1. Field of the Invention

The instant invention relates generally to wearing apparel and more specifically it relates to a multipurpose bandanna-type article.

2. Description of the Prior Art

Numerous wearing apparel have been provided in prior art. For example, U.S. Pat. Nos. 4,993,080 to Doty; 5,046,195 to Koritan; 5,058,211 to Hanks and 5,323,491 to Barrett, Jr. all are illustrative of such prior art. While these units may be suitable for the particular purpose to which they address, they would not be as suitable for the purposes of the present invention as heretofore described.

DOTY, ROBERT M.

Headband

U.S. Pat. No. 4,993,080

A headband comprising an imperforate piece of cloth having edges, a nominal fold axis, and ends of reduced width at the ends of said axis which can be tied together to form the headband. A message strip along the axis can carry a message on one side of the fold. A tassel strip is on the opposite side of the message strip from the fold. At least one tassel is fixed to it. When the cloth is properly folded, the tassel strip is against the head and the message strip is on the outside with its message visible. The tassel hangs fully exposed below the headband.

KORITAN, GILBERT

Head Band With Neck Shield

U.S. Pat. No. 5,046,195

An elastic head band is provided with a depending neck shield to protect the wearer's neck from sunburn. The head band may be worn in conjunction with a cap. The neck shield without the head band may be detachably connected to the rear of a cap.

HANKS, DARRELL L.

Bandanna-Type Article of Wearing Apparel

U.S. Pat. No. 5,058,211

A bandanna-type article of wearing apparel is fabricated from an integral piece of fabric folded in a manner to have forward and back panels of substantially triangular shape and an intervening pocket region. The configuration of the article is such that its upper edge is essentially the base of a triangle, and a downwardly directed apex constitutes the lower extremity of the forward panel. Tying ears extend from both extremities of the upper edge. A sheet of compliant thermally insulative material such as a polyurethane sponge is held by sewn seams within the pocket region.

BARRETT, JR., CHARLES R.

Headgear For Shielding Ears and Neck From Ultraviolet Rays

U.S. Pat. No. 5,323,491

An improved device for protective headgear for shielding ears and neck from ultraviolet rays which can be worn alone or in conjunction with a hat. This device is a stretchable headband with a crescent shaped sun shield attached to the headband. The sun shield gathers slightly when worn and extends outwardly from the head so that it does not lay directly over the ears. The shield is made of a tightly woven material which is also breathable, a single ply or preferably a two-ply material with a tightly woven micro denier on the outside and an all-cotton liner on the underside, which will be in contact with the back of the neck. A method for making the device also disclosed.

SUMMARY OF THE INVENTION

A primary object of the present invention is to provide a multipurpose bandanna-type article that will overcome the shortcomings of the prior art devices.

Another object is to provide a multipurpose bandanna-type article that can be worn around the head, bridge of the nose, neck, shoulders, chest, bust, waist, hips, thigh, knee, calf, ankle, wrist, elbow and the like.

An additional object is to provide a multipurpose bandanna-type article that can be worn under and over clothing to compliment what is already being worn, may be worn separately by itself or used independently as a flag, a pendant, a banner, a location marker and a signal buoy.

A further object is to provide a multipurpose bandanna-type article that is simple and easy to use.

A still further object is to provide a multipurpose bandanna-type article that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
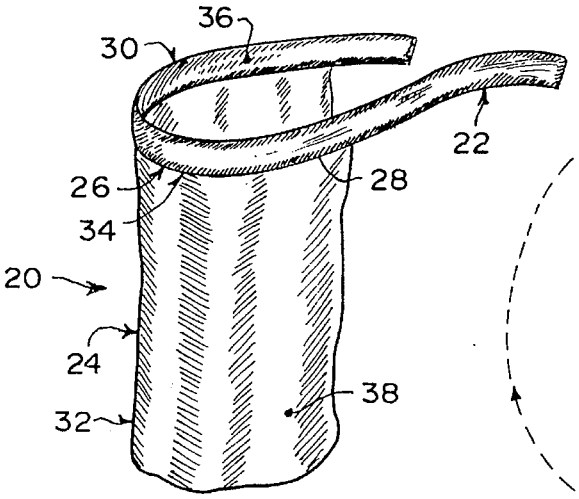
FIG. 1 is a perspective view of the instant invention per se.
Figure 2:
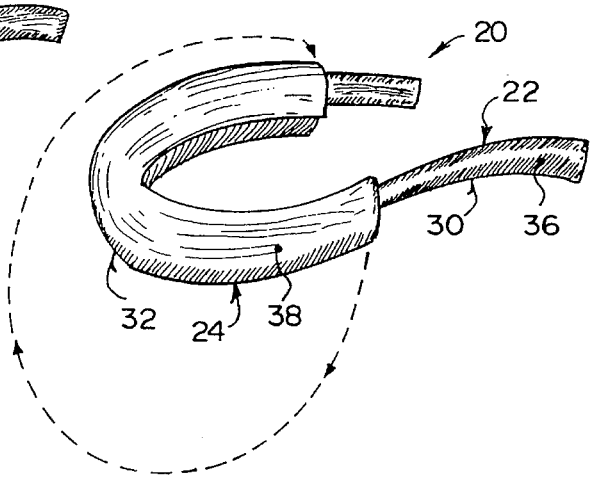
FIG. 2 is a perspective view of the instant invention with the flexible panel rolled up upon the elongated band.

Turning now descriptively to the drawings, in which similar reference characters denote similar elements throughout the several views, FIGS. 1 through 19 illustrate a multipurpose bandanna-type article 20, comprising an elongated band 22, a flexible panel 24 and a facility 26, for fastening one edge 28 of the flexible panel 24 to the elongated band 22.

The elongated band 22 is a thin strip of supple material 30. The flexible panel 24 is a thin flat rectangular piece of pliable material 32. The fastening facility 26 is a thread 34 sewn by stitching through the one edge 28 of the flexible panel 24 and into the elongated band 22.

The elongated band 22 is made from at least one material 36 selected from the group consisting of knitted fabrics, woven fabrics, and non-woven fabrics. The flexible panel 24 is made from at least one material 38 selected from the group consisting of knitted fabrics, woven fabrics and non-woven fabrics.

The knitted and woven fabrics for the elongated band 22 are selected from the group consisting of cotton, wool, linen, nylon, silk, polyester, terry cloth and combinations of any of these. The non-woven fabrics for the elongated band 22 are selected from the group consisting of plastic, paper, paper-type fabrics, leather, rubber, latex, man-made animal skins and authentic animal skins.

The knitted and woven fabrics for the flexible panel 24 are selected from the group consisting of cotton, wool, linen, nylon, silk, polyester, terry cloth and combinations of any of these. The non-woven fabrics for the flexible panel 24 are selected from the group consisting of plastic, paper, paper-type fabrics, leather, rubber, latex, man-made animal skins, authentic animal skins, man-made fur and authentic fur.

Figure 9:
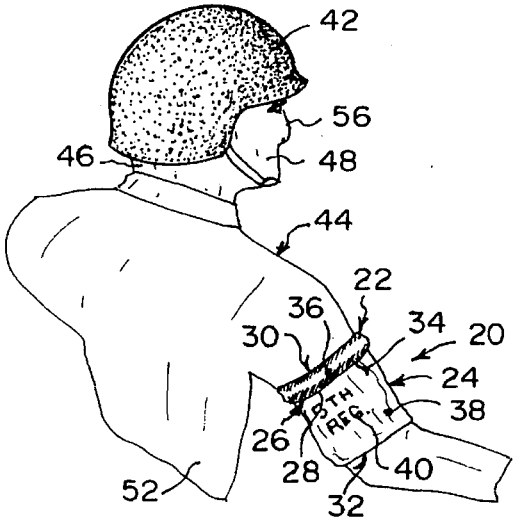
FIG. 9 is a perspective view showing the instant invention used as an identifying arm band.
Figure 10:
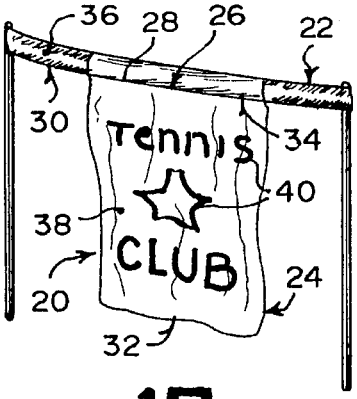
FIG. 10 is a perspective view showing the instant invention used as a flag, pendant, banner, location marker or signal buoy.

The flexible panel 24 as shown in FIGS. 9 and 10, can be printed with indicia 40. The indicia 40 is selected from the group consisting of a picture, a logo, a trademark and advertising material.

OPERATION OF THE INVENTION

Figure 3:
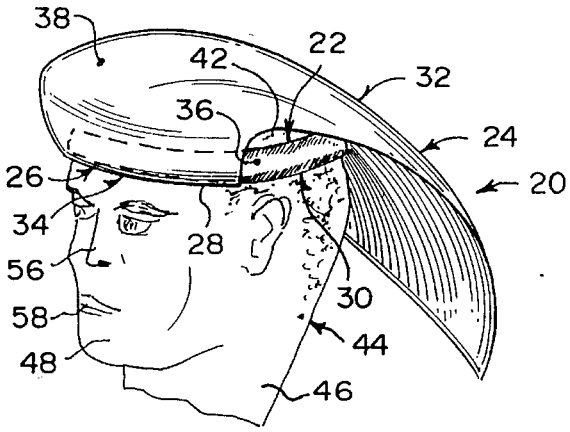
FIG. 3 is a perspective view showing the flexible panel pulled over a head of a person for protection from the sun.
Figure 4:
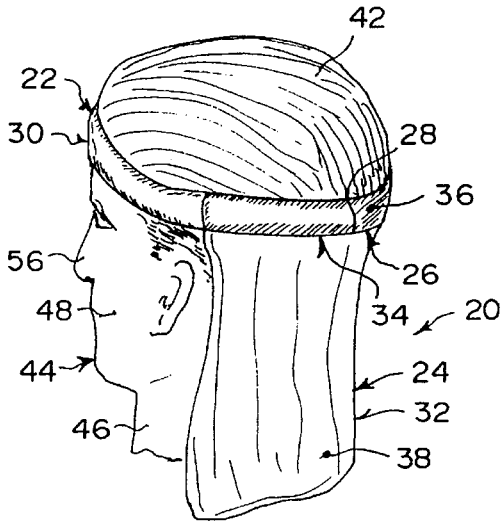
FIG. 4 is a perspective view showing the flexible panel worn backward on the head, to protect a neck of the person from the sun.
Figure 5:
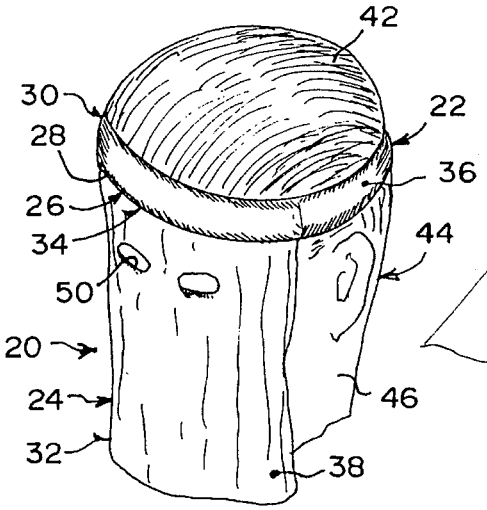
FIG. 5 is a perspective view showing the flexible panel pulled over a face of the person with holes cut into it for vision, to help protect the face.
Figure 6:
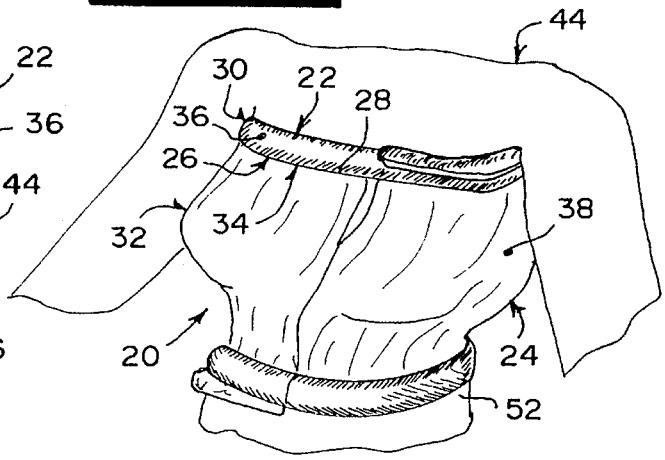
FIG. 6 is a perspective view showing the instant invention worn about the torso of a person.
Figure 7:
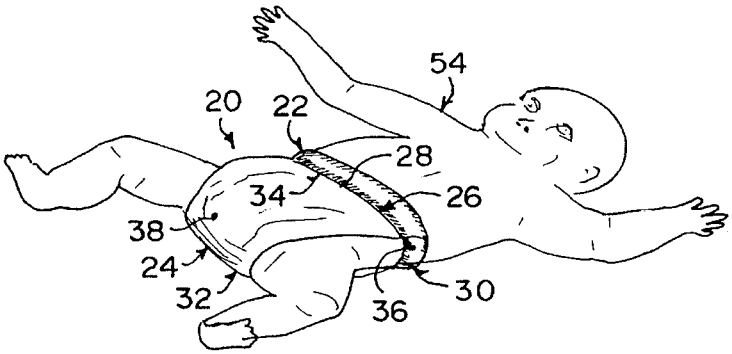
FIG. 7 is a perspective view showing the instant invention being used as a temporary emergency diaper on a baby.
Figure 8:
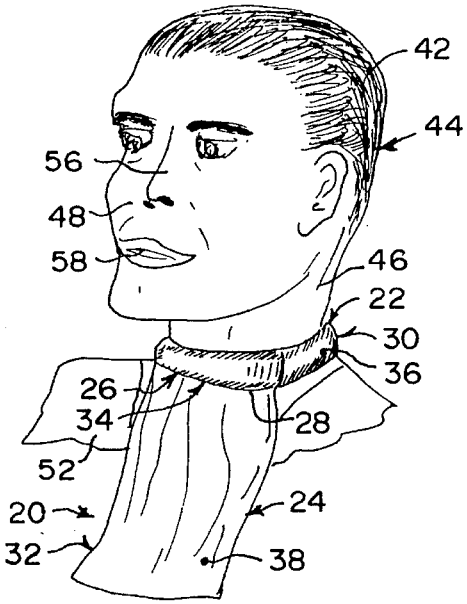
FIG. 8 is a perspective view showing the instant invention worn about a neck of a person, to be used as a make shift napkin.
Figure 11:
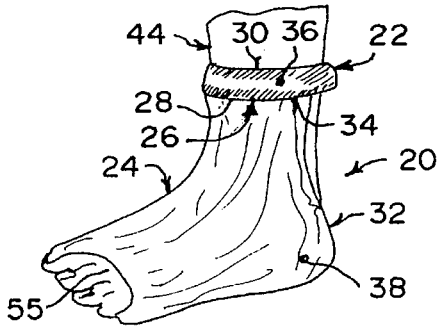
FIG. 11 is a perspective view showing the instant invention worn about a foot as a temporary sock.
Figure 12:
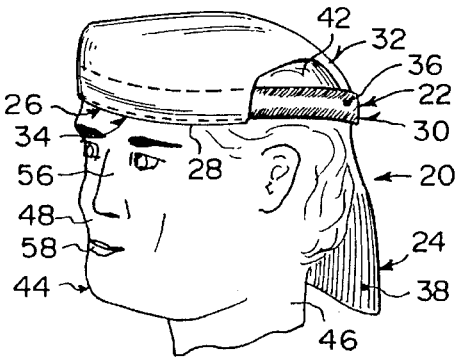
FIG. 12 is a perspective view with the flexible panel stretched over the top of the head of a person, to act as a hair net.
Figure 13:
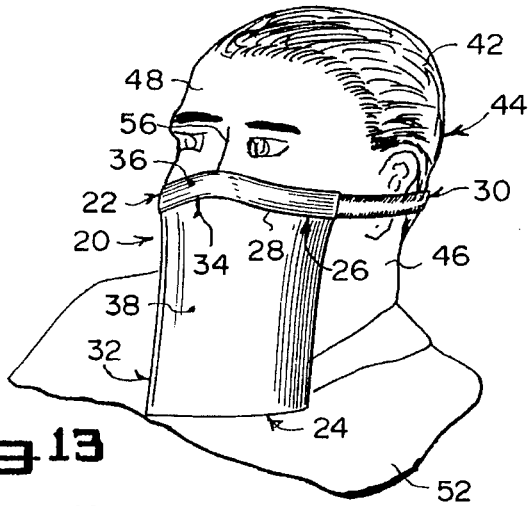
FIG. 13 is a perspective view of the instant invention worn about the head at the bridge of the nose to cover the nose and mouth.
Figure 15:
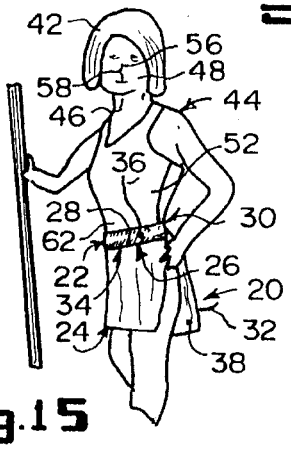
FIG. 15 is a perspective view showing the instant invention worn about the waist as a bathing suit, cover up or a very short open dress.
Figure 14:
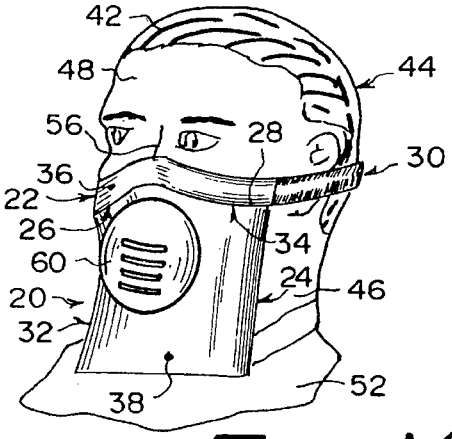
FIG. 14 is a perspective view similar to FIG. 13, but worn under a protective surgical mask to give extra protection.
Figure 16:
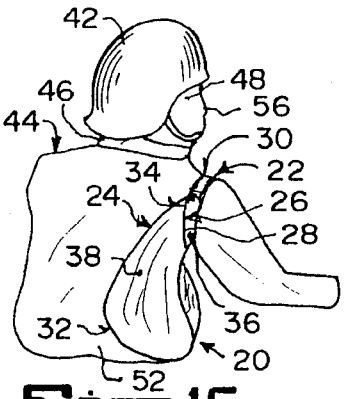
FIG. 16 is a perspective view showing the instant invention used as a small carrying pouch.
Figure 17:
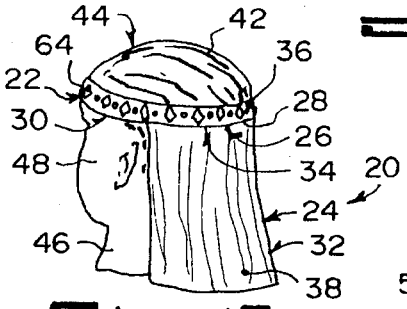
FIG. 17 is a perspective view showing the instant invention used as a female clothing accessory, by utilizing fine silks and precious gem stones thereon.
Figure 18:
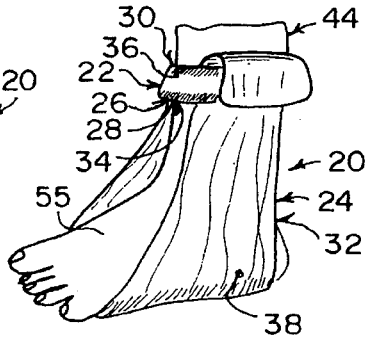
FIG. 18 is a perspective view showing the instant invention wrapped around the foot, to act as a temporary sandal.
Figure 19:
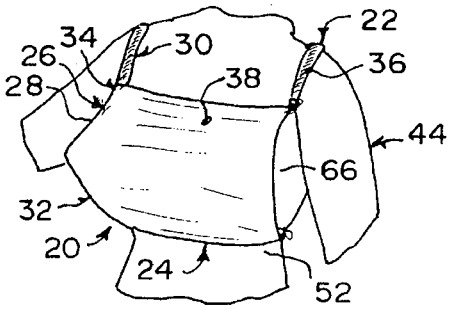
FIG. 19 is a perspective view showing the instant invention worn over the breast of a woman, to form a type of brassiere.

The multipurpose bandanna-type article 10 can be used as follows:

1. The flexible panel 24 can be pulled over a head 42 of a person 44 for protection from the sun, as shown in FIG. 3.
2. The flexible panel 24 can be worn backward on the head 42, to protect the neck 46 of the person 44 from the sun, as shown in FIG. 4.
3. The flexible panel 24 can be pulled over a face 48 of the person 44 with holes 50 cut into it for vision, to help protect the face 48, as shown in FIG. 5.
4. The article 20 can be worn about the torso 52 of the person 44, as shown in FIG. 6.
5. The article 20 can be used as a temporary emergency diaper on a baby 54, as shown in FIG. 7.
6. The article 20 can be worn about the neck 46 of the person 44 to be used as a make shift napkin, as shown in FIG. 8.
7. The article 20 can be used as an identifying arm band, as shown in FIG. 9.
8. The article 20 can be used as a flag, pendant, banner, location marker of signal buoy, as shown in FIG. 10.
9. The article 20 can be worn about a foot 55 as a temporary sock, as shown in FIG. 11.
10. The flexible panel 24 can be stretched over the top of the head 42 of the person 44 as a hair net, as shown in FIG. 12.
11. The article 20 can be worn about the head 42 at the bridge of the nose 56 to cover the nose 56 and mouth 58, as shown in FIG. 13.
12. The article 20 can be worn under a protective surgical mask 60, as shown in FIG. 14.
13. The article 20 can be worn about the waist 62 as a bathing suit, cover up or a very sort open dress, as shown in FIG. 15.
14. The article 20 can be used as a small carrying pouch, as shown in FIG. 16.
15. The article 20 can be used as a female clothing accessory by utilizing fine silks and precious gem stones 64 thereon, as shown in FIG. 17.
16. The article 20 can be wrapped about the foot 55 to act as a temporary sandal, as shown in FIG. 18.
17. The article can be worn over the breast 66 of a woman to form a type of brassiere, as shown in FIG. 19.

LIST OF REFERENCE NUMBERS

20: multipurpose bandanna-type article
22: elongated band
24: flexible panel

26: fastening facility
28: one edge of 24
30: thin strip of supple material for 22
32: thin flat rectangular piece of pliable material for 24
34: thread for 26
36: material of 22
38: material of 24
40: indicia
42: head of 44
44: person
46: neck of 44
48: face of 44
50: hole in 24
52: torso of 44
54: baby
55: foot of 44
56: nose of 44
58: mouth of 44
60: protective surgical mask
62: waist of 44
64: precious gem stones
66: breast of a woman It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multipurpose bandanna-type article for use on the head of a user comprising:

a) an elongated band consisting of a thin strip of supple material with free ends;

b) a flexible panel comprising a thin flat rectangular piece of pliable material whose width is such as to cover only the front of the face of a user including means for permitting a user to have visibility through said panel comprising a pair of spaced openings to permit viewing therethrough when said panel covers the face of a user, said piece of pliable material being otherwise free of openings; and c) means for fastening one edge of said flexible panel to said elongated band to permit said bandanna-type article to be worn backward over the head of a user while remaining secured to the head of the user comprising a thread sewn by stitching through said one edge of said flexible panel and into said elongated band.

* * * * *